United States Patent [19]

Lohner

[11] Patent Number: 4,973,939

[45] Date of Patent: Nov. 27, 1990

[54] POTENTIOMETER COMBINATION MOUNTED ON A CIRCUIT BOARD

[75] Inventor: Martin Lohner, Balingen-Ostdorf, Fed. Rep. of Germany

[73] Assignee: BSG-Schalttechnik GmbH & Co. KG, Meisterstrasse, Fed. Rep. of Germany

[21] Appl. No.: 338,591

[22] Filed: Apr. 14, 1989

[30] Foreign Application Priority Data

Apr. 16, 1988 [DE] Fed. Rep. of Germany ..... 3812791

[51] Int. Cl.[5] ..... H01C 10/00

[52] U.S. Cl. ..... 338/131; 338/132; 338/134; 338/197

[58] Field of Search ..... 338/132, 134, 197, 147, 338/163, 164, 184, 155, 315

[56] References Cited

U.S. PATENT DOCUMENTS 3,597,717 8/1971 Kent ..... 338/132
3,771,093 11/1973 Ishikawa et al. ..... 338/132

FOREIGN PATENT DOCUMENTS 0567017 1/1945 United Kingdom ..... 338/131

*Primary Examiner*—C. L. Albritton
*Attorney, Agent, or Firm*—Darby & Darby

[57] ABSTRACT

A balancing and a setting potentiometer, in combination, arranged one above the other in a common housing, mounted on a circuit board, with electric connections guided to the circuit board and with a full-length hollow shaft arranged for adjusting the potentiometers.

14 Claims, 1 Drawing Sheet

POTENTIOMETER COMBINATION MOUNTED ON A CIRCUIT BOARD

BACKGROUND OF THE INVENTION

The present invention relates to a potentiometer combination according to the preamble of claim 1.

In many cases, a plurality of potentiometers, which sometimes must be operable from the outside, are required for certain control and regulating functions in electric machines, for example hand-held electric tools, stationary working machines, or the like. Frequently, these potentiometers are then mounted separately on circuit boards or printed wiring boards, and their shafts are accessible through an opening in the housing, if and to the extent they must be adjustable from the outside.

The special embodiment described hereafter concerns a speed control and regulating module for electrically driven machines, for example hand drills, saws, grinders, or the like. A module suited for such devices comprises usually a setting potentiometer that can be adjusted (continuously) from the outside by means of a set wheel or another actuating element, for adjusting the potentiometer to given values, depending on the desired power output and speed. However, such a module requires in addition a balancing potentiometer, for example for adapting the module to the device to be controlled and the electric motor driving it, or for other reasons, for example for performing temperature adjustments, or the like. It should be noted that the present invention relates, preferably, to such applications although it is understood that it is by no means restricted to them.

Such modules then comprise several potentiometers which are mounted on a common circuit board or else at different points and which are used in part for adjusting or balancing functions, and in part for adjustments to be performed by the ultimate user, even after final assembly of the device, for example for presetting a desired speed (as set-point value). Quite apart from the fact that much space is required for arranging a plurality of potentiometers, any balancing of the existing trimmers or adjusting potentiometers has to be carried out on the finished module while it is not possible to perform any balancing maneuvers on the completely mounted device as the respective circuit boards are arranged inside the housing of the device and any balancing (or rebalancing) operation, for example when the completely assembled device is to be finely adjusted after assembly, can be carried out only by opening the housing and removing the circuit board, unless openings are admitted in the housing of a device which give access to the respective trimming or adjusting potentiometers. However, such openings must then be closed again, or else they would provide the risk of contamination by foreign particles or dirt particles produced during operation of the respective machine.

Now, it is the object of the present invention to design a potentiometer combination mounted on a circuit board in such a manner that a space-saving structure and at the same time easy accessibility of the balancing potentiometer is achieved so that subsequent adjustments are rendered possible after complete assembly of the device, in addition to the normally required regular adjustments of a given variable of the machine.

ADVANTAGES OF THE INVENTION

The invention solves this problem with the aid of the characterizing features of the main claim and provides the particular advantage that two potentiometers—which may at desire be absolutely independent of each other and which, preferably, may be provided with separate small housings—are designed and accommodated in a common pot-shaped overall potentiometer housing in such a manner that any trimming or setting operations to be carried out on either potentiometer can be performed via a common hollow shaft giving access simultaneously to both potentiometers. This makes it possible on the one hand to carry out any necessary adjustments and balancing operations more quickly. In addition, considerably less space is required as the potentiometer combination exhibits in fact a greater height, but this extension in height is much less critical than the space that would be required on the circuit board if an additional potentiometer were to be mounted thereon. Another advantage of the present invention is seen in the fact that even after complete assembly of the device, when normally only the shaft for the setting potentiometer for the desired variable of the machine (speed) is accessible from the outside, the balancing potentiometer which is then usually arranged below the setting potentiometer, viewed from this direction, is still accessible so that fine adjustments can be carried out subsequently or additional balancing operations can be performed on the assembly line. There is no need for additional openings in the housing of the respective device.

The features specified by the sub-claims describe advantageous developments and improvements of the potentiometer combination specified by claim 1. According to a first embodiment of the invention, the set wheel provided for the setting potentiometer, which can be operated from the outside, can be clicked on after completion of the assembly, or else one provides a firmly mounted set wheel comprising a full-length adjusting shaft forming the hollow shaft, in which case the adjusting or balancing potentiometer arranged below can be adjusted through this set wheel. The opening in the set wheel which communicates with the hollow shaft may then be closed by a blind plug or a small quantity of sealing compound.

BRIEF DESCRIPTION OF THE DRAWING

One embodiment of the invention will be described hereafter with reference to the drawing in which.

DESCRIPTION OF THE EMBODIMENTS

The basic idea of the present invention consists in providing a common housing of the type of a potentiometer pot which is arranged on a common circuit board and accommodates two potentiometers which are provided in superimposed arrangement, one above the other, and each of which may be designed as a self-contained potentiometer module enclosed in a separate housing, and in providing a hollow shaft giving simultaneous access to both potentiometers. Thanks to this arrangement, both the inner or lower first potentiometer, which may preferably be designed as balancing potentiometer, and the second, upper potentiometer—to which constant access may be required, for example, for carrying out permanent adjustments of an external variable of the machine—can be manipulated from the outside, i.e. from the area of the outer set wheel. One obtains in this manner the preferred embodiment of a setting potentiometer with integrated balancing potentiometer.

Figure 1:
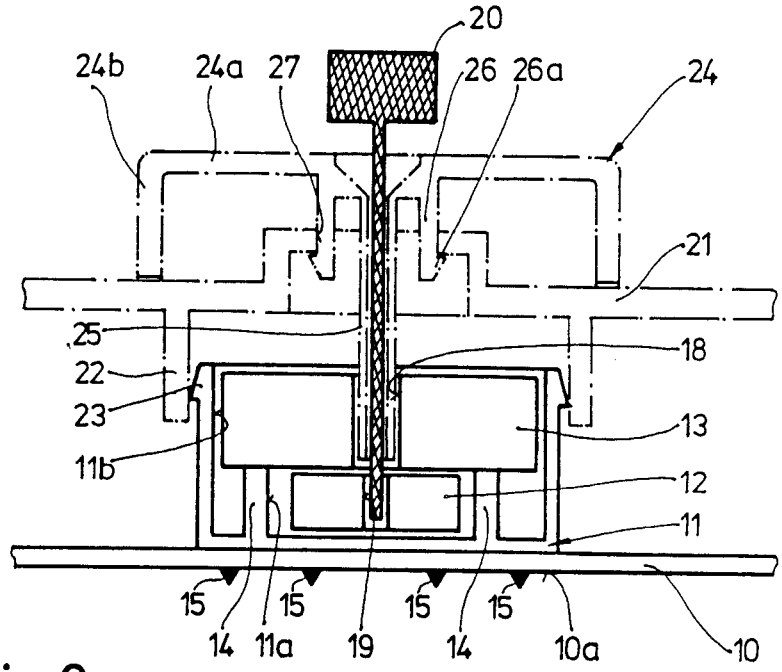
FIG. 1 shows a sectional elevation of a potentiometer combination with two potentiometers arranged one on top of the other, the associated circuit board and an indication of the outer housing.

FIG. 1 shows a printed wiring board or circuit board 10 and a common housing 11 for the two potentiometers which is mounted on this board and exhibits the shape of a potentiometer pot.

The common housing 11 comprises receiving spaces for a first potentiometer which will be described hereafter, for distinguishing purposes, as balancing potentiometer 12, and for a second potentiometer which will be described hereafter as setting potentiometer 13. It is understood, however, that the invention is by no means limited to these particular descriptions; rather, the potentiometers may be assigned any desired functions, it being merely important that both potentiometers 12 and 13 are fixed against rotation and arranged in a common housing in such a manner that they can be manipulated simultaneously through a common shaft. This aspect will be described in more detail further below.

Given the fact that in the case of the embodiment illustrated in the drawing the balancing potentiometer 12 has much smaller dimensions, as regards its circumference and/or height, than the setting potentiometer 13—which is in fact reasonable as the balancing potentiometer will be actuated very seldom, maybe even once only—the common housing 11 provides a smaller receiving space 11*a* adjoining its bottom, which space 11*a* may be defined by annular walls or at least wall portions 14.

The second setting potentiometer 13 is then mounted above and on the annular wall 14. The potentiometer connections of both potentiometers are guided through corresponding bores—not shown in the drawing—in the bottom of the common pot housing 11 and up to the circuit board 10 and are, preferably, fixed to the rear face 10*a* (conductor face) of the circuit board 10 by soldering, as indicated by reference numerals 15. The soldering points may at the same time form electric contacts to conductors provided on the conductor face 10*a*.

These connections already give the structure comprising the common housing 11 and the two potentiometers 12 and 13 arranged therein the required support on the circuit board 10 and at the same time the necessary resistance against rotation. According to preferred embodiments, however, the common housing 11 is clicked or pressed upon the circuit board 10 or fixed to the latter in any other suitable manner, for example by riveting, so that the soldered connections do not have to fulfill the additional functions of supporting the potentiometers and/or of securing them against rotation.

Accordingly, it is then also advisable to design the respective receiving spaces 11*a* and 11*b* of the common housing 11 for the potentiometers 12 and 13 in such a manner that the potentiometers are retained against rotation in the receiving spaces 11*a*, 11*b* by their own self-contained housings. This may be achieved, for example, by adapting the inner contour of these spaces to the outer contour of the individual potentiometer housings; for, as can be seen in FIG. 2, the shape of the potentiometer housings is not exactly circular, but exhibits a rectangular projecting marginal edge 16 in the area of the connection contacts of the potentiometer, and this edge may be used for fixing the potentiometers against rotation in their respective receiving spaces.

Figure 2:
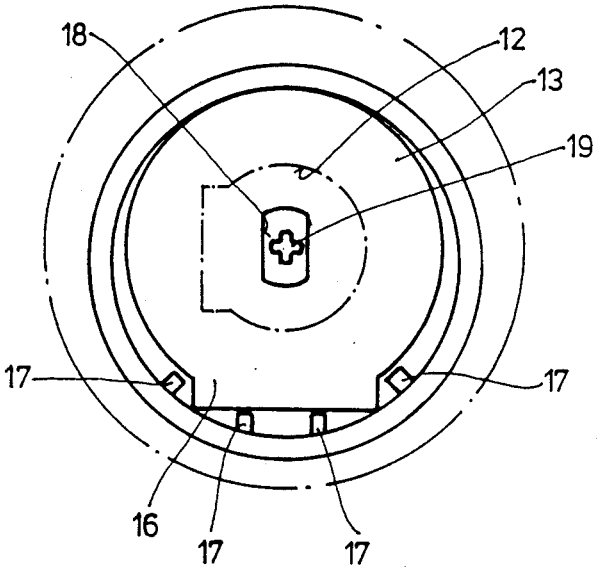
FIG. 2 shows a top view according to FIG. 1 of the two potentiometers arranged one on top of the other, with the structure of the housing removed, but with the set wheel indicated in broken lines.

As indicated in FIG. 2 for the second setting potentiometer, one may provide for this purpose, for example, ribs 17 projecting from the inner wall of each receiving space and coacting with corresponding recessed portions provided in the marginal edge 16 of the potentiometer housing for retaining the latter against rotation.

From the representation of FIG. 1 it appears that the two potentiometers 12, 13 are arranged in the pot forming the common housing 11 in such a manner that their setting shafts are aligned exactly above each other, and the shaft of the upper potentiometer 13, through which the lower potentiometer 12 has to be actuated, too, takes the form of a full-length hollow shaft 18 of non-circular cross-section—as can be seen best in FIG. 2—so that this upper setting potentiometer 13 can be rotated and adjusted by a correspondingly shaped axle or journal of a set wheel to be applied from the outside (this feature will be described in more detail further below). The hollow shaft 18 forms a full-length bore extending through the housing of the potentiometer 13 and enables in this manner the setting or actuating opening 19 of the first balancing potentiometer 12 to be reached, too. According to a first embodiment of the invention it is, therefore, possible to introduce a narrower actuating element 20—related to the hollow shaft 18—through the hollow shaft 18 of the second potentiometer 13 and into the setting opening 19 of the first potentiometer 12, for carrying out any necessary balancing or adjusting operations (and to remove this element again upon completion of these maneuvers). As appears from FIG. 2, this setting opening 19 is also given a special cross-sectional configuration. In the illustrated embodiment, it exhibits the cross-sectional shape of a crossed slot, which means that the end of the actuating element 20 must have the configuration of a cross-head or normal screwdriver so that it can be brought into firm engagement with the setting opening for rotation thereof.

Once the adjusting operations on the balancing potentiometer have been carried out—for example when the module is still open, but already mounted on the circuit board 10—the module can be installed in the device for which it is intended.

Alternatively, it is however also possible, and even preferred according to the present invention, to install the control or regulating module, which already has been mounted on the circuit board 10 (not shown in the drawing) and which comprises the two potentiometers 12 and 13 as additional electric components, in the device which is to be controlled or regulated with the aid of this component, for example the hand drill, saw, a stationary machine, or the like.

In FIG. 1, a partial area of the outer housing structure of the device is designated by reference numeral 21. The assembly may be effected, for example, in such a manner that the outer housing comprises an inwardly projecting annular wall 22 which comes into active and sealing engagement with a projection 23 extending around the whole periphery of the common housing 11 so that the electric/electronic module as mounted on the circuit board 10, in the present case the potentiometer pot as common housing 11, is at the same time safely supported and guided by means of the described sealing engagement at the housing and other additional fixing means not shown in the drawing.

For actuating the setting potentiometer 13, an outer set wheel 14, as indicated diagrammatically by dash-dotted lines in FIG. 1, may then be provided.

Even after assembly of the module in the outer housing of the device or of the machine, it is then possible to effect adjustments or balancing operations more quickly through the hollow shaft 18, or to perform the final fine adjustment of the finished device subsequently, for example before the set wheel 24 is fixed in place, or during final assembly on the conveyor belt. Thereafter, the set wheel 24 is clicked in place so that no additional openings are needed in the outer housing. However, adjusting operations can be carried out even after final assembly of the set wheel, as will be explained in more detail further below.

The set wheel 24 comprises a circular collar **24*b* extending downwardly from its bottom 24*a*, and a central setting shaft 25 which may also be designed as a hollow shaft, in particular when it is intended to adjust, i.e. to rotate, the balancing potentiometer 12 even after assembly of the set wheel 24. This central setting shaft 25, therefore, supplements and completes the hollow shaft of the upper balancing potentiometer 13 insofar as it enables the actuating element 20 to be introduced through the hollow shaft 25—as can be seen best in FIG. 1—of the actuating element 20, for being brought into engagement with the setting opening 19 of the lower balancing potentiometer 12**.

For securing the set wheel 24 in place, the latter may be provided with an additional inner circular collar 26 which is introduced into a locking and supporting opening 27 of the outer housing 21—which may, for example, also project outwardly—whereby an outwardly projecting annular edge **26*a*** is brought into locking engagement with the outer housing.

Alternatively, the pot shape of the common housing 11 may be extended upwardly—in the drawing plane of FIG. 1—until the set wheel 24 can be locked in place directly on the common potentiometer pot housing.

The representation of FIG. 1 shows that when the actuating shaft 25 of the set wheel 24 is designed as hollow shaft, adjusting operations are possible even after final assembly of the set wheel, in which case the hollow shaft then forms an adjusting shaft whose opening may be closed at desire by a blind plug after completion of the adjusting operations.

It is understood that the pot shape of the common housing may also be enclosed or filled up by a sealing compound, if desired.

All features shown in the drawing and described in the specification and the following claims may be essential to the invention either alone or in any combination thereof.

I claim:

1. Potentiometer combination mounted on a circuit board, characterized by: a common housing arranged on the circuit board; said common housing designed in the form of a potentiometer pot housing, two potentiometers fixed against rotation and arranged one on top of the other in said housing and having electric connections guided to the circuit board; a full-length hollow shaft arranged in at least one of the potentiometers, through which both potentiometers are accessible from the outside for adjusting purposes, wherein one of the potentiometers being a balancing potentiometer and the other potentiometer being a setting potentiometer which can be operated continuously in normal operation by an external set wheel, the balancing potentiometer is arranged in the common housing below the second potentiometer, said common housing including an internal annular wall for receiving the balancing potentiometer and for supporting the setting potentiometer.

2. A dual potentiometer combination according to claim 1, characterized in that an inner wall of the common housing is adapted to the irregular outer contour of each potentiometer to prevent rotation of said first and second potentiometers.

3. A dual potentiometer as recited in claim 2, further comprising a plurality of ribs projecting inwardly from said inner wall for securing said potentiometers.

4. Potentiometer combination mounted on a circuit board, characterized by: a common housing arranged on the circuit board; said common housing designed in the form of a potentiometer pot housing, two potentiometers fixed against rotation and arranged one on top of the other in said housing and having electric connections guided to the circuit board; a fulllength hollow shaft arranged in at least one of the potentiometers, through which both potentiometers are accessible from the outside for adjusting purposes, wherein one of the potentiometers being a balancing potentiometer and the other potentiometer being a setting potentiometer which can be operated continuously in normal operation by an external set wheel, the balancing potentiometer is arranged in the common housing, below the second potentiometer, said common housing including an internal set wheel for receiving a journal, said set wheel having a central annular projection spaced from the journal, by which it can be introduced into a receiving and supporting opening of the common housing and brought into locking engagement with an outwardly projecting annular edge.

5. A dual potentiometer comprising:

first and second discrete, separately actuated potentiometers each having an adjusting axes, first and second housings respectively receiving said first and second potentiometers therein, a common housing receiving said first and second housings therein, said first housing disposed on top of said second housing so said adjusting axes of said first and second potentiometers are coaxially aligned;

a full length hollow shaft in said first potentiometer and adapted to receive a separate adjusting element to adjust said second potentiometer, said first and second potentiometers being adjustable independently of each other and accessible from a top portion of said common housing through said coaxially aligned axes;

wherein all the electrical connections of the dual potentiometer are guided to a circuit board.

6. A dual potentiometer according to claim 5, further comprising an external set wheel, the hollow shaft forms a setting opening for the first potentiometer and has a non-circular shape for receiving a journal of said wheel for rotating therewith.

7. A dual potentiometer according to claim 6, characterized in that the set wheel has a hollow shaft coaxially aligned with the hollow shaft of the first potentiometer, the journal having a hollow design and a cross-section such that a removable actuating element can be introduced through the hollow shaft of the set wheel and brought into engagement with a setting opening of the second potentiometer.

8. A dual potentiometer according to claim 7, characterized in that the setting opening of the second potentiometer exhibits at has the shape of a slot.

9. A dual potentiometer according to claim 5, further comprising an outer housing having an inwardly projecting annular wall, and the common housing is shaped in the form of a potentiometer pot housing and includes an upwardly projecting edge, said projecting edge comprises an outwardly projecting sealing lip engaging said inwardly projecting annular wall for sealing purposes.

10. A dual potentiometer as recited in claim 5, wherein said first potentiometer is a setting potentiometer and said second potentiometer is a balancing potentiometer.

11. A dual potentiometer as recited in claim 5, wherein said common housing is in the form of a potentiometer pot housing and comprises first and second receiving spaces for said first and second potentiometers.

12. A dual potentiometer according to claim 11, characterized in that, said first and second potentiometers each having a setting shaft arranged concetrically to each other, and a plurality of passage openings for electric supply lines of the first and second potentiometers provided in a bottom portion of the common housing.

13. A dual potentiometer as recited in claim 8, wherein said slot is in the shape of a crossed slot.

14. A dual potentiometer as recited in claim 11, further comprising an external set wheel for continuously operating said setting potentiometer.

* * * * *